US005156880A

United States Patent [19]

Inculet

[11] Patent Number: 5,156,880

[45] Date of Patent: Oct. 20, 1992

[54] SPACE CHARGE ELECTROSTATIC COATING METHOD AND APPARATUS

[75] Inventor: Ion Inculet, London, Canada

[73] Assignee: Nordson Corporation, Westlake, Ohio

[21] Appl. No.: 650,048

[22] Filed: Feb. 19, 1991

[51] Int. Cl.[5] ..... B05D 1/04; B05B 5/10

[52] U.S. Cl. ..... 427/483; 118/626; 118/635

[58] Field of Search ..... 407/26, 27; 427/31, 427/33; 118/626, 635

[56] References Cited

U.S. PATENT DOCUMENTS 2,662,833 12/1953 Helmuth ..... 427/33

*Primary Examiner*—Evan Lawrence

*Attorney, Agent, or Firm*—Wood, Herron & Evans

[57] ABSTRACT

A method and apparatus for electrostatically spraying conductive coating material onto objects, primarily large extended objects, by charging with a relatively large charge the space behind the surface to be coated. With hollow objects, such as automobile bodies, the space within the body is charged. The space is charged by spraying an electrostatically charged atomized water mist into the space which evaporates charging the space and object surface. An electrostatic field is produced between the surface and the gun which, along with the supply of conductive material to which it is connected, is grounded. The gun discharges a film of coating which is atomized into droplets. The field inductively charges the film fringe and thus the droplets which are then attracted onto the large charged surface.

30 Claims, 2 Drawing Sheets

SPACE CHARGE ELECTROSTATIC COATING METHOD AND APPARATUS

The present invention relates to an electrostatic coating method and apparatus and more particularly to a method and apparatus for electrostatically applying water-based coatings or other conductive coatings.

BACKGROUND OF THE INVENTION

The electrostatic application of coating materials such as paint is most often carried out by applying a high voltage charge to a powder or atomized mist of liquid coating material which is sprayed into the air in the vicinity of the objects to be coated, and then electrostatically attracting the airborne charged material toward the object, which is grounded or charged at the opposite potential. The charged material so attracted envelopes and thereby coats the entire object.

In a number of coating applications, the use of water-based liquid coatings has found increasing desirability. For example, the use of water-based paints produces less solvent emissions, which must be carefully controlled in a plant, than the use of organic-solvent based paints. In addition, many flammable solvent-based paints present fire hazards, whereas water-based paints are less flammable. Furthermore, the cost of solvent-based paints has become much higher than that of water-based products. These considerations, as well as the availability of improved water-based coatings, have motivated a shift toward the water-based coatings. This shift has been significant where spraying paint onto large objects on open assembly lines is employed, as, for example, with the painting of cars in the automobile industry.

The use of water-based paints has its own problems. A problem presented by the use of water-based paints in electrostatic spray systems is that the water-based coating liquids are conductive. For this reason, the fluid path from the paint supply reservoir to the spray orifice, where the charging electrode is typically located is a continuous liquid conductor. As such, the use of water-based paints with electrostatic spray devices requires electrical isolation of the entire paint supply system. Otherwise, the charging electrode of the gun will be grounded out through the paint supply and the entire system would present a shock hazard to operating personnel.

In large scale manufacturing facilities, such as those found in the automobile industry, electrical isolation of the paint supply system is indeed a monumental task. Such systems involve large paint tanks and extensive piping throughout large automotive plants which makes effective electrical isolation of the system highly impractical.

Attempts to charge an atomized spray of water-based coating material after it is discharged from the spray device so that the supply system may itself be kept at ground potential have been attempted by using inductive or other methods. Such methods of the prior art have not adequately focused the electrostatic field on the product being painted to control overspray.

Accordingly, there has been a need for an effective method and apparatus by which a water-based or other conductive spray coating can be charged and electrostatically attracted in a focused way to an object to be coated. There has been a particular need for an effective method and apparatus for electrostatically applying water-based or other conductive coating material in a coating system where isolation of the coating supply is impractical or undesirable.

SUMMARY OF THE INVENTION

It has been an objective of the present invention to provide a method and apparatus for uniformly coating objects with an electrostatic coating device with conductive coating material without requiring that the source be electrically isolated from ground potential. It has been a further objective of the present invention to provide an improved method and apparatus for electrostatically inducing a charge on a conductive coating material.

According to principles of the present invention, a method and apparatus for spraying coating material upon an object from a paint spray discharge device is provided by having a large volume behind the object to be painted injected with a "space charge" having a large potential or voltage relative to the material sprayed from the discharge device so as to induce a charge on the coating material. Space charge, as used herein, means the charge created by a cloud of charged droplets. It is the total charge produced by the summation of the charges that are present on the water droplets suspended in the air which comprises the space charge. The space charge carried within the object to be coated produces an electrostatic field surrounding the object since the object is isolated from ground. A spray device for the conductive coating material is electrically grounded so that the coating material within the device is electrically grounded. The spray device is located within the electrostatic field so that an opposite charge is induced on the coating material by electrical induction as the coating material is dispensed from the spray device towards the charged object. The induced charge is opposite in polarity by the space charge carried within the object. The combined effect of the inductively charged coating spray and the oppositely and uniformly charged object to be coated results in an effective electrostatic attraction of the coating to the object and a uniform deposit of the coating material upon the surface of the object, particularly since there are no stray field lines. That is, the charged coating material is attracted only to the charged object since all field lines emanate from the charge object and not from the spray device.

In one preferred and illustrated embodiment of the present invention, large, hollow objects to be coated, such as automobiles having conductive or non-conductive bodies, are coated with water-based coating, e.g., liquid water-based paint, from a grounded electrostatic coating source. The automobile bodies are positioned adjacent the coating spray device, isolated from ground potential and subjected to a space charge generated from an electrostatically charged airborne fluid. The fluid is preferably a gas, and preferably formed by the evaporation of a charged sprayed liquid, preferably atomized water or water vapor.

The space charge is an electrostatically produced charge introduced into a volume adjacent to and behind the surface of the object to be coated. The charge may be imposed by a voltage from 30 to 50 kilovolts from an electrode at the fluid discharge device. With the large hollow objects such as the automobile bodies, a charged gas is injected into the interior of the body, for example, through a grill opening, to fill the interior of the body and to distribute the electrostatic charge throughout the interior volume and onto the interior surface of the object.

The space charge is, in one preferred embodiment, a positive charge, which distributes itself about the interior volume and/or surfaces bounding the charged spaced within the body of the object. If non-conductive hollow bodies are used, the charge will be retained on the interior surface. Where the object bodies are metal or of other conductive material, the charge will be conducted through the body to the exterior surface. In either situation, a strong widely distributed uniform charge will be present on the extended body of the object to be coated.

The charge produced in this manner within the objects to be coated in accordance with the principles of the present invention results in the production of an electric field having electric lines of force which propagate from the body of the object and toward an array of grounded spray coating discharge devices positioned adjacent the object. In the presence of this electric field, an atomized spray of aqueous conductive coating material is ejected from the electrically grounded nozzle of the spray device toward the object to be coated. The atomization of the conductive material is preferably achieved with a rotary atomizer which sprays the coating material into the air and toward the object.

The atomization of the coating method involves the spraying of a thin liquid film from the atomizer. This film, once so sprayed extends from the atomizer to a fringe region where a charge opposite that of the object, negative if the object is positively charged, is induced by the electric field. The charge induced at the fringes of the liquid film is carried by the coating material which detaches from the continuous liquid supply to form discrete particles in the course of atomization. Then, small or microscopic coating liquid droplets which the atomizer produces carry these negative charges into the atmosphere. These charges proceed along the electric field lines toward the object to be coated, engulfing it and attaching uniformly to its surface. The negatively charged droplets of the conductive spray material are thereby uniformly attracted to the object coating the object with a uniform coating.

The present invention provides the advantage of making it possible to use a grounded source of coating material to effectively and uniformly coat substantial areas of large numbers of objects, particularly large hollow objects, with conductive coating. The ability to electrically ground sources of conductive paint in a large coating system of a facility, such an automobile body assembly plant, allow for the use of water-based paint. This reduces hazards within the plant due to the toxicity of the coating material, electrical shock hazards and fire hazards. These advantages are absent from both electrically isolated water-based sources or those using solvent-based coating products.

The space charge method for subjecting the objects to be coated to electrostatic charge provides a uniform and effective manner of creating electrostatic potential difference between a grounded paint spray source and the coatable objects. This is true whether or not the objects are made of conductive or non-conductive materials. Furthermore, the amount of charge which is applied to large extended objects by the present invention produces electric fields which will induce charge on the conductive spray coating material which is sufficiently strong, even from a grounded source, to produce uniform attractive forces for causing the coating material to uniformly envelope and coat the objects.

These and other objectives and advantages of the present invention will be readily apparent from the following detailed description of the drawings.

DETAILED DESCRIPTION OF THE DRAWINGS

Figure 1:
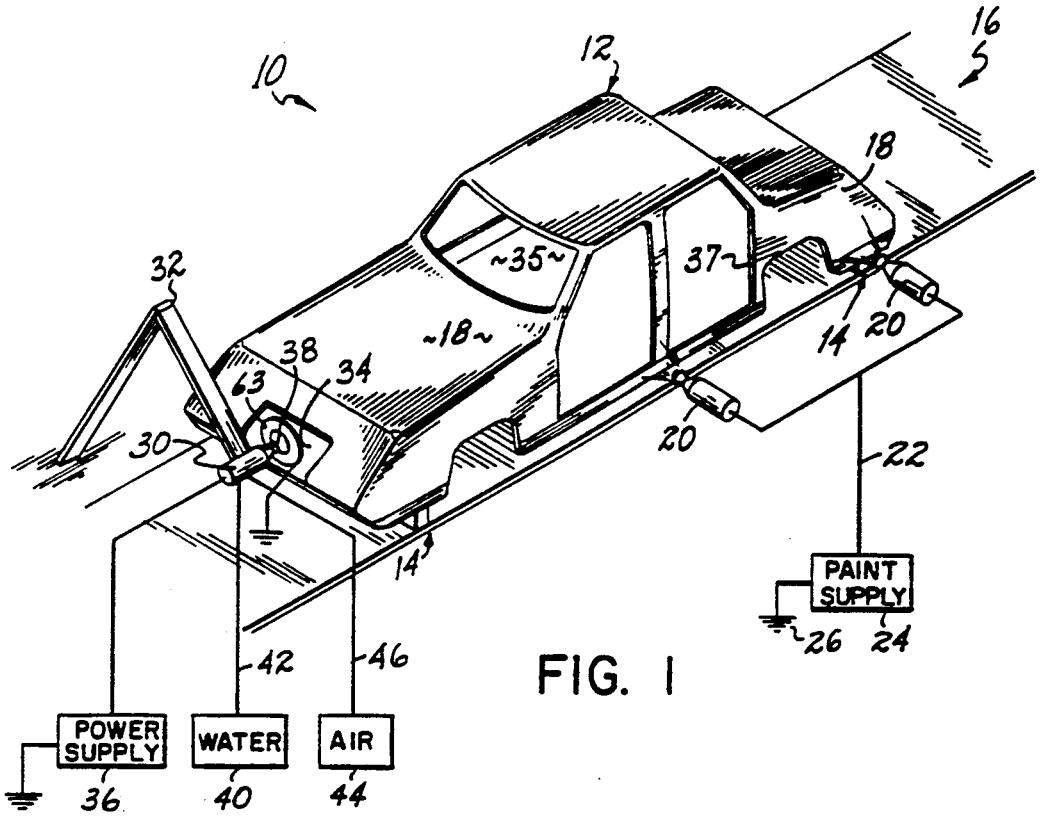
FIG. 1 is an isometric drawing of a portion of an automobile assembly line coating spray system according to one preferred embodiment of the present invention.

Referring to FIG. 1, a coating spray station 10 in an automobile assembly plant is diagrammatically illustrated. The diagram illustrates an automobile body 12 on insulated supports 14 being moved on a conveyor 16 through the coating station 10. Positioned at the station 10 adjacent to the insulated support 14 are a plurality of electrostatic spray guns 20, each positioned sufficiently close to the outer surface 16 of the automobile body 12 on the support 14 as to be within the field produced by the charge which will be imparted to the body 12. The dimensions of the automobile body 12 are thus large in relation to distance of the guns 20 from the surface 16. To each of the guns 20 is connected a coating supply line 22 through which pressurized coating, preferably water-based paint in liquid form, is supplied to the gun 20 from a remote paint reservoir 24. The reservoir 24 is electrically grounded to the plant ground 26. The aqueous paint supplied from the reservoir 24 through the line 22 to the guns 20 is electrically conductive. Accordingly, it exhibits low resistance to the flow of electricity between the atomizer of the guns 20 and the ground 26. Thus, the paint is at or near ground potential throughout the path through lines 22 and the guns 20.

The guns 20 are preferably of the rotary atomizer type. Such a gun includes a rotating cup or disk which will spin at a high rate of speed so as to centrifugally atomize the paint. Other types of atomizing methods such as conventional air or airless methods may also be employed. The atomizing guns 20 operate with relative movement between the gun and the surface 16 of the object to the painted. In this case, either the automobile body 12 moves past the guns during painting or the guns are moved manually or by robot-like devices along the automobile body 12 at the station 10. These guns 20 operate to discharge a fine mist of atomized paint toward the object to be painted.

Adjacent the work station 10 is a space charge generation device 30 mounted to an insulated plastic support arm 32 at the work station 10. The device 30 is positioned or positionable so as to inject a cloud of electrically charged mist, gas or vapor through an opening or grid 34 into the interior 35 of the automobile body 12. Preferably, the charge is imparted to the gas at a point outside of the body 12 and injected through the opening 34 into the hollow space within the automobile body 12. In this way a large volume of charged gas will be contained within the object onto which the coating is to be applied.

The nozzle end 38 of the device 30 injects the water droplets which are charged by the power supply 36 through an opening in a metal plate 63 which is connected to ground. Nozzle end 38 is behind metal plate 63. The plate 63 prevents the induction of opposite charges on the water due to the space charge contained within the body 12 which would otherwise limit the amount of charge which would be injected into the body.

To the device 30 is connected an electrostatic power supply 36 of approximately 50,000 kilovolts. This power supply 36 supplies the energy to charge the carrier gas or vapor discharged into the space 35 which is bounded by the inner surface 37 of the object body 12. The charge is transferred to the gas or mist as it is discharged from a nozzle 38 of the device 30. Any one of a number of charging techniques such as contact charging, corona discharge or inductive charging methods, may be employed to charge the gas. The space charge device 30 may, for example, be any one of a number of electrostatic spray devices which operate to release a stream of charged gas, vapor or finely atomized liquid from the nozzle 38. In the preferred embodiment, the nozzle 38 is equipped with an ultrasonic atomizer. One such atomizer nozzle 38 is, for example, sold under the trademark "Sonimist" by Heat Systems Ultrasonic, Inc. of Farmingdale, NY. Such a nozzle will eject a finely disbursed cloud of liquid, atomized through ultrasonic atomization technique, through the opening 34 in the automobile body 12. In the preferred embodiment, such a nozzle 38 operates with the device 30 to create mist of water from a supply 40 connected to the device 30 through a water supply line 42. The water supply 40 is electrically isolated from ground. The water from supply 40 is sprayed from the nozzle 38 and combined with a stream of low pressure air from air supply source 44. The air is also directed through the device 30 through an air line 46. While the spray device 30 is charged by power supply 36, the water supply 40 and the air supply 44 are electrically isolated from ground.

The device 30 operates to discharge a cloud of water droplets, according to the preferred embodiment, which are so finely atomized as to quickly evaporate when sprayed into the air and form an unsaturated air or dry vapor air mixture. When sprayed, the droplets are each imparted with a charge, preferably positive, as they are dispersed from the nozzle 38. The charged droplets from nozzle 38 pass through the grill or other opening 34 to the interior 35 of the automobile body 12 where they completely evaporate, filling the volume of the inner space of the body 12 with dry positively charged water vapor gas. The charge density and volume of the charged space will be such that the total space charge is large relative to that needed to electrostatically charge the coating material. Preferably, the total space charge is so large as to render that amount needed to charge the coating material insignificant in comparison.

As the positive electrically charged water molecules accumulate within the space 36 within the automobile body 12, they generally repel each other and are dispersed outwardly toward the inside surface 37 of the automobile body 12, thus transferring charge to the inside surface of the body to be coated. If the automobile body is conductive, a portion of the electrical charge will be conducted through the body 12 from interior surface 37 to the exterior surface 18 of the automobile body 12. If the body is made of a non-conductive material, such a thermosetting plastic, the charge will tend to accumulate on the interior surface 37 of the automobile body. In either case, an electric field will be produced by both the charge on the inside, outside or both surfaces of the automobile body 12 and the space charge within the interior 35 of the body. This electrostatic field will emanate from and be generally perpendicular to various points along the automobile body 12 and will curve and extend toward the electrically grounded portions of the spray nozzles 20 as is, for example, illustrated schematically in FIG. 2. The electric field lines are illustrated at 50 in the drawing of FIG. 2.

The positive charge on the surface area of the automobile body 12, in combination with the charged gas within the space behind the surface of the body 12, produces the field 50 which interacts with the grounded spray devices 20 to induce opposite, negative, charges on the atomized paint as it is sprayed from the guns 20. This is shown more particularly in FIG. 3.

Figure 3:
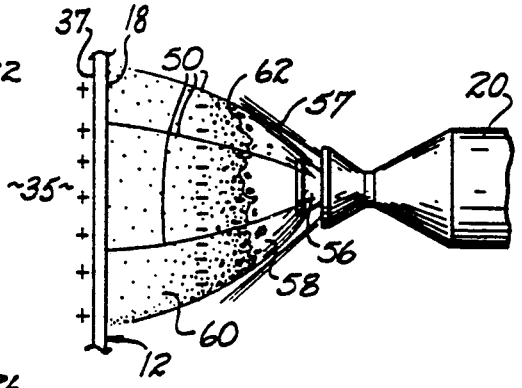
FIG. 3 is a drawing of the atomization and inductive charge features of the system of FIGS. 1 and 2.

Referring to FIG. 3, the preferred embodiment is shown in which a rotary atomizer type gun 20 is employed. Such a device is provided with a rotary cup 56 which ejects a fine film 58 of liquid paint, in this case water-based paint, as is shown in FIG. 3. The film 58 is disbursed into the air a distance from the cup 56 before breaking up into droplets 60 at the film edge 62. The electric field 50 acts upon this thin film 58 so as to attract electrons from the grounded gun 20 through the film 58 to the film edge 62. At the film edge or fringe 62, the film 58 breaks up into droplets 60, which carry the negative charge induced to the film edge 62.

As shown in FIG. 3, the lines of electric force 50 which emanate from automobile 12 (FIG. 1) converge onto the grounded film 58 of conductive water-based paint 58 being ejected from the atomizer cup 56 of the gun 20 which is at ground potential. The atomized spray is directed toward the object usually by a collar or stream of air 57 surrounding the cup 56. One such suitable atomizer described in part in U.S. Pat. No. 4,380,321 expressly incorporated herein by reference. The electric field, which attracts electrons to the fringes of the film 58 to be released along with the droplets 60 to form the negatively charged spray of the paint, also attracts the charged droplets 60 to the surface 18 of the body 12. Accordingly, the positively charged body of the car itself operates both as the electrode for inducing the negative charge on the paint which is sprayed from the gun 20 and as an electrode to attract the paint. The same charge source which produces the electric field 50 and which is effective to induce a charge in the spray is also the source for attracting the charged paint spray droplets 60 to the body 12. Accordingly, the guns 20 and the paint within them remain at essentially ground potential, while the atomized mist sprayed from the guns is imparted with a negative inductive charge. The induced charge is sufficient to cause the attraction of the charged droplets toward and around the body of the automobile 12 impinging upon and uniformly coating the surface 18.

Figure 4:
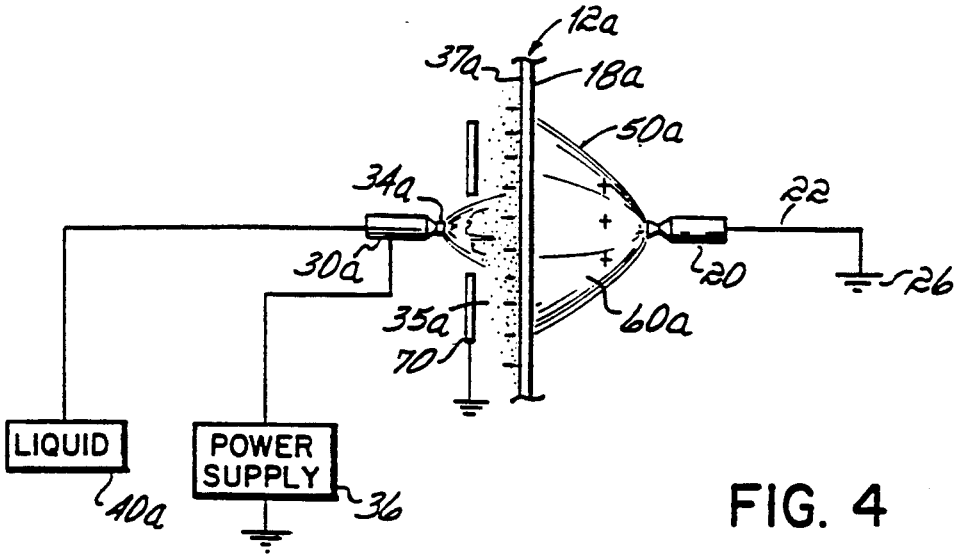
FIG. 4 is a schematic diagram similar to FIG. 2 of an alternative application of the present invention.

FIG. 4 shows an alternative application of features of the present invention to coat non-hollow objects **12*a*. In this embodiment a space 35*a* behind a preferably large thin, object 12*a* is charged as the object moves through the station 10*a* past the electrostatic spray gun 20. In a manner similar to that of the embodiment of FIGS. 1–3, an electrostatically charged water mist (shown negatively charged in this embodiment) from an atomizing nozzle 30***a*, which may also be similar to the nozzle 30 of FIGS. 1–3, discharges the charged water mist through a grounded metal plate 63*a* into the space 35*a*. This develops a charge which distributes itself generally along the back surface 37*a* of the object 12*a*.

Figure 2:
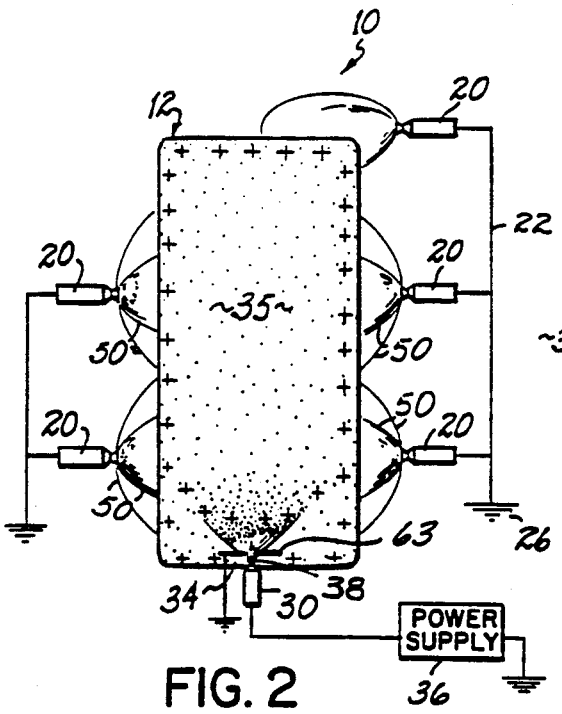
FIG. 2 is a schematic drawing of the electrical portion of the system of FIG. 1.

An atomizer spray gun 20, as described in connection with FIGS. 1–3, discharges atomized conductive coating from a grounded source, producing droplets 60*a* which, as explained in connection with FIG. 3, are inductively charged (in this case to a positive charge) and are attracted along field lines 50*a* to the front surface 18*a* of the object 12*a*. The charged space 35*a* is charged in a manner similar to that of the hollow object 12 of FIGS. 1–3 to contain a large volume of charge distributed behind the extended area of the object 12*a* to produce the field 50*a* to inductively charge and attract the spray droplets 60*a* across the surface 18*a*.

In addition, an alternative to the use of water as the liquid 40*a*, other gas or liquid carriers may be employed. Gases such as carbon dioxide or nitrogen may, for example, be used as an alternative to water. Such liquids turn to gas at standard ambient temperatures and pressures. These gases may, in some applications be used where an increase in moisture which would result from the use of water is undesirable.

However, water or other liquid is preferred in that it has sufficient mass, and thus can be injected with sufficient momentum, to be blown through a grounded shield and into a hollow body or space behind the object surface.

Having described the invention, the following is claimed:

1. An apparatus for electrostatically coating a hollow object with material sprayed from a supply of electrically conductive liquid coating material, the object having an exterior surface to be coated and an interior space defined by the object, said apparatus comprising:

an electrically grounded reservoir containing a supply of electrically conductive liquid coating material;

a coating station having means thereat for supporting the object in electrical isolation from ground potential;

at least one coating spray gun having an outlet positioned adjacent said object for discharging a grounded liquid coating material from said gun, said outlet having means connected thereto for atomizing the material discharged from said outlet to form minute coating droplets therefrom;

means for transporting the liquid coating material from said reservoir to said gun; and means for charging the space within the object to generate between the object and the grounded liquid material being discharged from said outlet an electrostatic field for inductively charging, with an electric charge opposite the charge of the space, the discharged coating material and the droplets being formed therefrom to enhance the attraction of the droplets of coating material to the exterior surface of the object.

2. The apparatus of claim 1 wherein said space charging means comprises means for charging a gas and means for injecting the charged gas into the interior space.

3. The apparatus of claim 2 wherein the gas is water vapor.

4. The apparatus of claim 3 wherein said water vapor is formed from the evaporation of droplets of water mist, and wherein said charging means further comprises means for producing said droplets of water mist and means for imparting an electrostatic charge to said droplets of water mist before the evaporation thereof.

5. The apparatus of claim 4 wherein said mist producing means comprises an ultrasonic atomizer.

6. The apparatus of claim 1 wherein the object is large in relation to the spacing between the object and the coating spray gun.

7. The apparatus of claim 1 wherein said space charging means comprises means for injecting a dry charged gas into the object.

8. The apparatus of claim 7 wherein said dry charged gas is water vapor.

9. The apparatus of claim 7 wherein said injecting means comprises means for directing into the object a charged water mist which evaporates to produce water vapor.

10. An apparatus for electrostatically coating the surface of an object with material sprayed from a supply of coating material, the object having a front surface to be coated and having a space behind and adjacent thereto defined at least in part by the object, said apparatus comprising:

a reservoir containing the supply of electrically conductive coating material which is grounded or maintained at a fist potential;

a coating station having means thereat for supporting the object in electrical isolation from ground potential;

at least one coating discharge device having an outlet positioned adjacent said surface for spraying a coating material from said device toward said surface;

means for transporting the coating material from said reservoir to said discharge device; and means for charging said space to a second potential to generate an electric field between the object and the coating material being discharged from said outlet, said field being effective for inductively charging, with an electrostatic charge opposite the charge of said space, the sprayed coating material to enhance the attraction of the sprayed coating material to said the surface.

11. The apparatus of claim 10 wherein said coating material is a liquid coating material, and said outlet of said discharge device has means connected thereto for atomizing the liquid discharged from said outlet to form minute coating droplets.

12. The apparatus of claim 10 wherein said space charging means comprises means for charging a gas and means for injecting the gas into a confined space behind the surface of the object.

13. The apparatus of claim 12 wherein the gas is water vapor.

14. The apparatus of claim 13 wherein said water vapor is formed from the evaporation of droplets of water mist, and wherein said charging means further comprises means for producing said droplets of water mist and means for imparting an electrostatic charge to said droplets of water mist before the evaporation thereof.

15. The apparatus of claim 14 wherein said mist producing means comprises an ultrasonic atomizer.

16. The apparatus of claim 10 wherein said coating material is approximately at ground potential at said discharge device.

17. The apparatus of claim 10 wherein said space charging means imparts a charge to the space.

18. The apparatus of claim 10 wherein the object is large in relation to the spacing between the object and the coating discharge device.

19. A method of electrostatically coating a surface of an object with coating material supplied from a grounded supply, said method comprising the steps of:

supporting the object at a coating station;

electrostatically isolating the supported object from ground;

positioning at least one coating discharge device having a coating discharge nozzle adjacent said coating station;

enclosing at least in part by said object a space adjacent said object and opposite said surface from said discharge device;

charging said space to generate an electric field between the object and said nozzle; and spraying the coating material at ground potential into said field so as to inductively charge the sprayed coating material to enhance the attraction of the sprayed coating material to the surface of the object.

20. The method of claim 19 for electrostatically coating a hollow object having an interior surrounded at least in part by the surface and containing said space, wherein said charging step further comprises the step of:

charging said space within the object to generate the electric field between the object and the coating material being sprayed from said nozzle.

21. The method of claim 20 wherein said space charging step comprises the step of charging a gas and injecting the charged gas into the interior of the object.

22. The method of claim 19 wherein said charging step further comprises the steps of producing droplets of water mist, imparting an electrostatic charge to said droplets of water mist, injecting the charged droplets of water mist into the space and evaporating the injected charged droplets within the space to charge the space opposite the surface from the nozzle.

23. The method of claim 19 wherein said charging step includes the step of imparting a positive charge to said space.

24. The method of claim 19 for electrostatically coating the surface of an object from a supply of electrically conductive liquid coating material, the object having an interior defined within the surface, said method further comprising the step of:

transporting the liquid coating material along a continuous path from said supply to said discharge device so as to electrically ground the nozzle of the discharge device and the liquid material being sprayed therefrom.

25. The method of claim 19 wherein said enclosing step includes the step of providing an electrically grounded plate positioned adjacent said coating sation to at least in part enclose said space between said plate and said object.

26. The method of claim 19 wherein said space charging step includes the step of spraying from a liquid source a material which forms a gas at ambient temperature and pressure and imparting an electrostatic charge to said discharged material to fill said space with charged gas.

27. The method of claim 26 where the gas is nitrogen.

28. The method of claim 26 wherein the gas is carbon dioxide.

29. The method of claim 19 wherein the spraying step includes the step of spraying the material from the grounded supply through a grounded discharge device toward said object.

30. The method of claim 19 wherein said coating material is a conductive liquid and said spraying step includes the step of atomizing the sprayed liquid to form minute coating droplets, said droplets being inductively charged to enhance the attraction thereof to said surface.

* * * * *